US007005994B2

(12) United States Patent
King

(10) Patent No.: US 7,005,994 B2
(45) Date of Patent: Feb. 28, 2006

(54) SMART FIRE ALARM AND GAS DETECTION SYSTEM

(75) Inventor: Samuel King, Carmel, NY (US)

(73) Assignee: Annex Security and Technical Services, Carmel, NY (US)

( * ) Notice: Subject to any disclaimer, the term of this patent is extended or adjusted under 35 U.S.C. 154(b) by 61 days.

(21) Appl. No.: 10/681,023

(22) Filed: Oct. 8, 2003

(65) Prior Publication Data

US 2005/0078003 A1 Apr. 14, 2005

(51) Int. Cl.
*G08B 17/10* (2006.01)

(52) U.S. Cl. ..... 340/628; 340/506

(58) Field of Classification Search ..... 340/628, 340/506, 629, 630, 632
See application file for complete search history.

(56) References Cited

U.S. PATENT DOCUMENTS

| | | | | | |
|---|---|---|---|---|---|
| 3,826,180 | A | | 7/1974 | Hayashi | 98/43 |
| 4,257,319 | A | * | 3/1981 | Kucharczyk | 454/256 |
| 4,489,308 | A | * | 12/1984 | Logan et al. | 340/628 |
| 4,911,065 | A | | 3/1990 | Van Becelaere | 98/1 |
| 4,977,818 | A | * | 12/1990 | Taylor et al. | 454/342 |
| 5,074,137 | A | * | 12/1991 | Harris et al. | 73/31.02 |
| 5,215,498 | A | | 6/1993 | Wong et al. | 454/208 |
| 5,379,026 | A | | 1/1995 | Whittle | 340/632 |
| 5,451,929 | A | * | 9/1995 | Adelman et al. | 340/521 |
| 5,576,739 | A | * | 11/1996 | Murphy | 340/3.4 |
| 5,748,081 | A | | 5/1998 | Lin | 340/555 |
| 5,973,603 | A | * | 10/1999 | Judy | 340/628 |
| 6,036,595 | A | | 3/2000 | Vole | 454/239 |
| 6,110,038 | A | | 8/2000 | Stern | 454/343 |
| 6,359,567 | B1 | | 3/2002 | Park | 340/632 |
| 6,774,802 | B1 | * | 8/2004 | Bachinski et al. | 340/632 |

* cited by examiner

*Primary Examiner*—Jeffery Hofsass
*Assistant Examiner*—Eric Blount
(74) *Attorney, Agent, or Firm*—Davidson Davidson & Kappel, LLC.

(57) ABSTRACT

A smart alarm system determines when fire, carbon monoxide, or both are present in a specific area and responds accordingly. If fire is detected, alarms are activated, emergency services are notified, and ventilation, namely vents and fans, is cut off in the specific area where the hazard is detected. If carbon monoxide is detected, alarms are activated, emergency services are notified, and ventilation is increased by opening vents and activating exhaust fans to dissipate the gas from the area containing the gas. In the event both are detected, the system will keep the ventilation cut off to prevent the spread of fire.

16 Claims, 6 Drawing Sheets

SMART FIRE ALARM AND GAS DETECTION SYSTEM

BACKGROUND

In the case of detecting smoke, fire, and high heat in a building, it is desirable to cut off the flow of air within the entire building to prevent smoke from circulating, fire from burning, and to retard heat flow. Automatically closing fire dampers for air ducts are well known. However, these automatic closable damper devices only operate in the room in which the fire occurs. Additionally, most buildings have a ventilation system, such as an air conditioner or a furnace, which includes a blower for circulating air in the building. If the blower is allowed to operate during, for example, a fire the circulated air will feed the fire. Therefore, in addition to closing the vents, the blower is usually disabled.

The possibility of carbon monoxide poisoning is a serious safety hazard. Carbon monoxide accounts for one half the fatal poisoning in the United States each year, from a minimum of about 200 to as many as 1500. Carbon monoxide is a serious hazard because of its strong attraction to hemoglobin which normally combines with oxygen in the lungs and carries it throughout the body. When carbon monoxide is present, it replaces the oxygen and, in high enough concentration, poisoning can result.

Carbon monoxide is a by-product of incomplete combustion. Since it is odorless and colorless, there is no warning of its presence. Carbon monoxide sources include automobile exhaust fumes, furnaces, kitchen gas ranges, water heaters, fireplaces, charcoal grills, and small gasoline engine operated equipment. Moreover, with the current concern for energy efficiency, many recently built homes do not provide adequate fresh air flow. Homes are tighter because of more insulation, caulking, insulating window films and weather stripping. If there is inadequate fresh air flow, the opportunity arises for carbon monoxide build-up. Carbon monoxide poisoning is more of a problem during the winter because heating systems are running.

While precautions can be taken to minimize the possibility of carbon monoxide poisoning, accidental leaks do occur, so it is advisable to utilize carbon monoxide detectors. Chemical detectors are available which are the least expensive but require monitoring. These use carbon monoxide sensitive chemicals which change color when exposed to a specified level of the gas. Electronic detectors are more expensive but do not need to be monitored as they sound an alarm when specified levels of carbon monoxide are present.

SUMMARY OF THE INVENTION

The present invention provides an intelligent warning system comprising a control circuit (such as a processor) operably connected to a detector, an alarm, and a ventilation system. The circuit receives data from the detector and activates the alarm and ventilation system as a function of the data. If a fire is detected, the alarms are activated and the ventilation system is configured to cut off ventilation and rob the fire of its oxygen supply. If carbon monoxide is detected, the alarms are activated and the ventilation system is configured to draw the carbon monoxide out and fresh air in.

BRIEF DESCRIPTION OF THE DRAWINGS

FIG. 9 is a wiring diagram for an alternative embodiment of the module in FIG. 6.

DETAILED DESCRIPTION

While electronic detectors are effective in warning occupants of a home or business of of excessive carbon monoxide levels, they can be ineffective, for example, if the home is unoccupied or if the occupants are asleep and do not hear the alarm. Another danger is an automobile occupant inadvertently closing the garage door and falling asleep while the motor runs. In addition, none of the currently available systems differentiate their response to the presence of fire alone, CO alone, or both at the same time. Accordingly, a system that would respond to detection of CO, gas or both intelligently is desirable.

The present invention provides a smart fire alarm and CO warning system that responds locally according to the detection of fire alone, carbon monoxide (CO) alone, or both at the same time. In the event a fire is detected, ventilation is cut off to prevent the fire from spreading in the area where the fire is detected. If CO is detected, vents are opened to allow fresh air in and an exhaust fan is activated to remove the noxious gas from the affected area. In both cases, audio and visual alarms will sound in the structure being monitored. A communications link allows the system to alert a central call station, as well as the local fire department, police department, and nearest treatment center. In the event that both fire and CO are detected, the system maintains ventilation cut-off to prevent the spread of fire.

Figure 1:
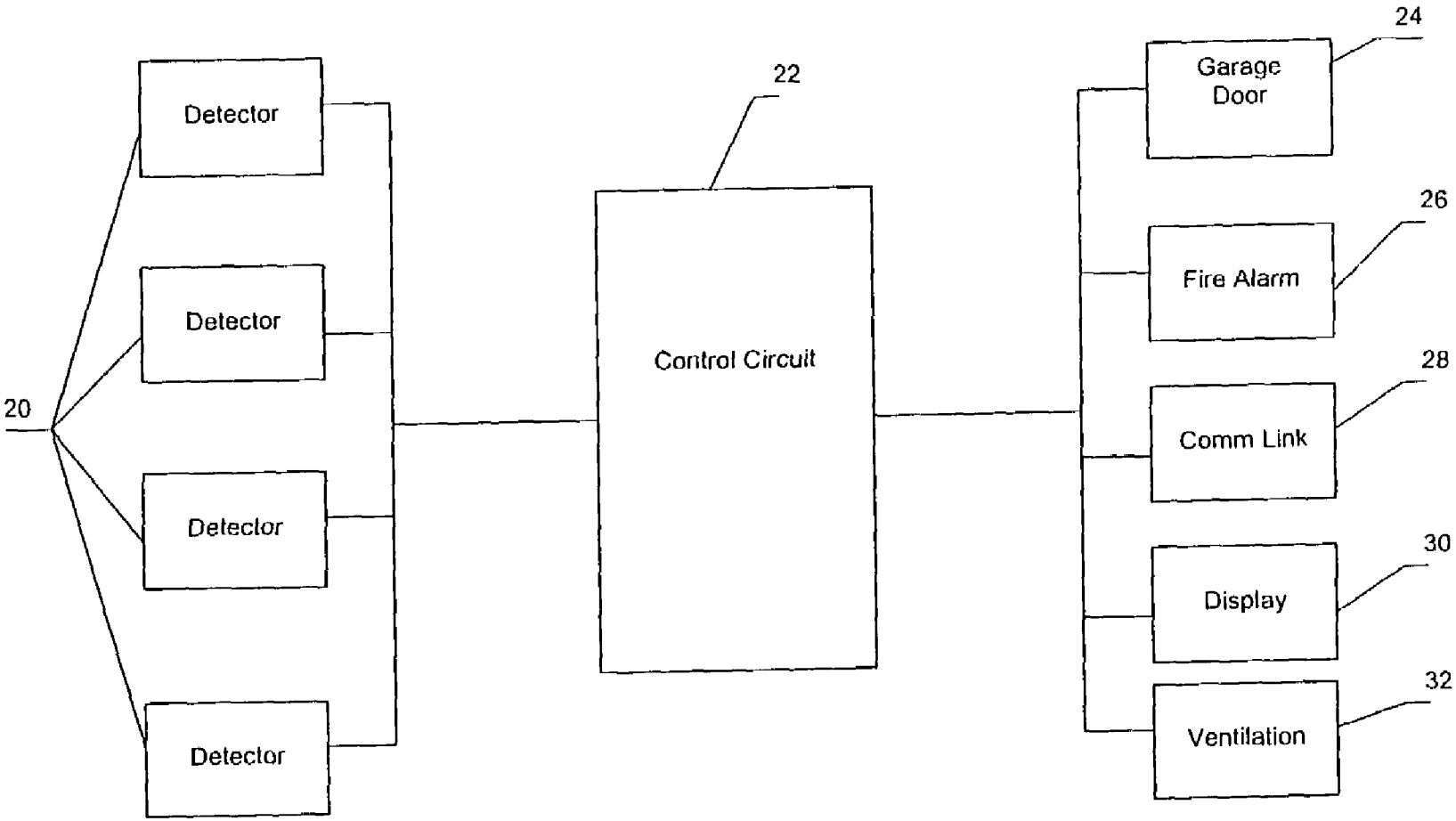
FIG. 1 is a block diagram of the smart alarm system according to an embodiment of the present invention.

FIG. 1 shows a block diagram of the detection system in accordance with an embodiment of the present invention. A number of detectors 20 are placed throughout a structure. The detectors 20 are designed to detect smoke, fire, CO and high temperatures. Each detector 20 is operably connected to a control circuit 22 that receives signals from the detectors and activates system components accordingly. In accordance with one aspect of the present invention, the control circuit 22 is microprocessor-based with appropriate control software loaded onto the microprocessor's memory. Alternatively, the control software may be hard-wired using logic gates.

The circuit 22 is operably connected to a garage door 24, an audio-visual alarm 26, a communications link 28, a visual display 30 and a ventilation system 32. The microprocessor of the circuit 22 operates on a system clock where one tick is a passage of one unit of time. With the passage of each tick, the processor receives and evaluates information from the detectors 22 that is reviewed to determine if a hazard is present, and if so, activate the appropriate system components in the locations where a hazard is located.

Each detector 20 is placed in a specific zone of a monitored structure to provide spatial distinction in the system. In other words, system reaction is location-specific, e.g., increasing ventilation in the garage only or in the garage and adjacent rooms only. Identification signals from each detector 20 that accompany the data sent to the control circuit 22 identify the detector 20 and let the circuit 22 know where the detector 20 is located. In this way, the circuit 22 can determine where system information, and hence, a detected hazard, is coming from.

Figure 2:
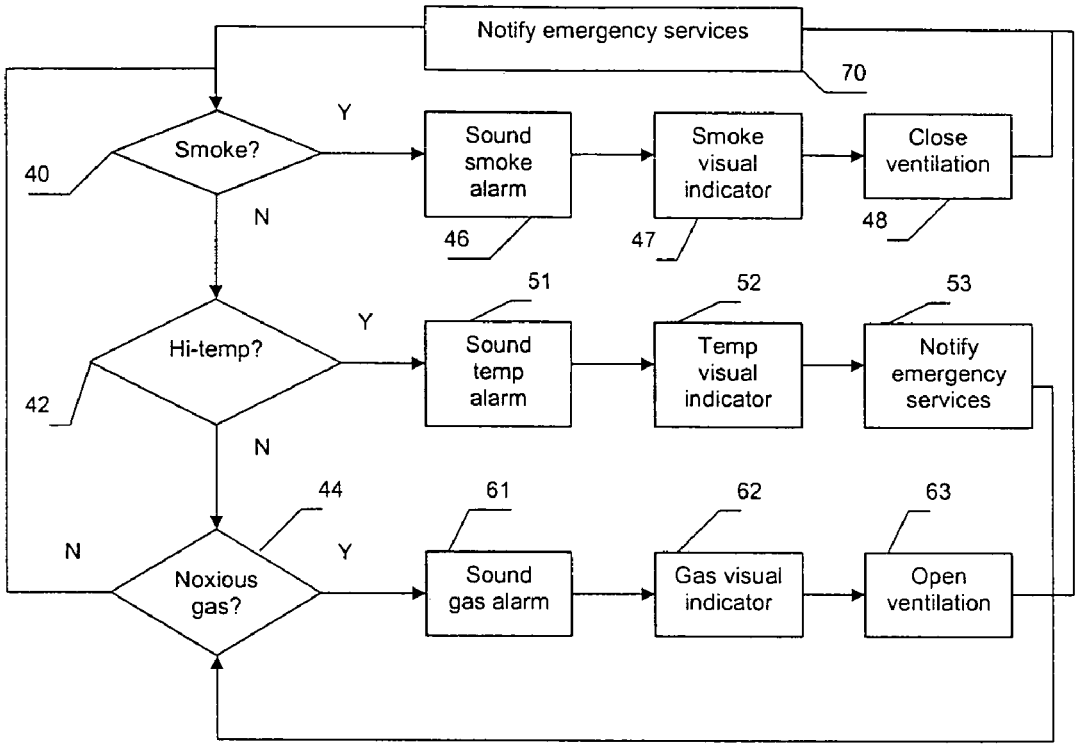
FIG. 2 is flowchart for the logic implemented by the system of FIG. 1.

FIG. 2 is a flowchart for an exemplary implementation of the logic used by the system. The system starts by checking the detector information for smoke (step 40). If smoke is not detected, the temperature is checked for unusually high levels which may indicate the presence of a fire (step 42). If there is no smoke (step 40) and no high temperature (step 42), the system checks for the presence of CO (step 44). If the system determines that there is no CO (step 44), then it loops back to check for smoke (step 40). In effect, the system continually checks for smoke (step 40), high temperatures (step 42) and CO (step 44) until one is found.

If smoke is detected (step 40), the system will sound a corresponding smoke alarm (step 46) which may be unique to the detection of smoke. Visual indicators are activated as well (step 47) which may include strobe lights and LEDs on a central display. In accordance with further aspects of the present invention, the central display may be designed to indicate what area of the monitored structure contains the detected hazard. The ventilation system shuts any vents and disables exhaust fans (step 48) in the area containing the hazard and any adjacent areas deemed to be a threat. Emergency services are notified (step 70) via the communications link which may include police and fire departments, a central monitoring station, emergency medical services, treatment centers, and even contacting the home owner or tenant of the monitored structure via cell phone or pager, if the system is so configured. After notifying the appropriate parties via the communication link (step 70), the system loops back to check if smoke is still present (step 40). The system will continue to sound the alarm (step 46), display the visual indicators (step 47), keep the ventilation system closed (step 48), and notify the appropriate parties (step 70) until smoke is no longer detected (step 40).

It should be noted that if CO is present, the system will still keep the ventilation system closed to prevent the spread of fire. As long as smoke is present and detected, the system will not go beyond the steps taken in response to a detected fire (steps 46–48).

If smoke is not detected (step 40) but an unusually high temperature is (step 42), the corresponding, audible temperature alarm is activated (step 51) as well as the visual indicator (step 52). Again, the visual indicator may include strobe lights placed throughout the monitored structure as well as LEDs on a central display for indicating system status in addition to the location of the detected hazard. Emergency services are notified (step 53) and the presence of noxious gas is evaluated (step 44).

If noxious gas is detected (step 44), the audible gas alarm is activated (step 61) with its corresponding visual indicator (step 62). Vents are opened and exhaust fans are activated (step 63) in the area containing the gas. In accordance with one embodiment of the present invention, as part of the localized response system, the ventilation system may include means for opening a garage door in the event CO is detected in a garage, allowing fresh air into the area of the noxious gas, thereby greatly reducing the noxious gas concentration. The system then begins its loop to continually check for smoke (step 40), abnormally high temperatures (step 42) and noxious gas (step 44) and continues to activate the audio-visual alarms and notify emergency services until the detected hazard is no longer present.

If, on the first pass, neither smoke (step 40), nor high temperature (step 42) is detected, the system checks for the presence of noxious gas (step 44) in which case, an audible alarm is activated (step 61) along with a visual indicator (step 62) and the ventilation system is activated to open vents and switch exhaust fans on (step 63) in the local area designated for the detector sensing the hazard. From here (step 63), the system loops back to the beginning of the cycle and if smoke is detected (step 40), indicating that both fire and noxious gas is present, the system will follow the fire alarm path of steps 46–48, keeping the ventilation system closed to prevent the spread of fire, and will remain closed until smoke is no longer detected (step 40).

Preferably, alarms and indicators will be turned off manually by resetting the system. This will ensure that the cause of each alarm is inspected and not ignored. A code may be entered into a keypad on the central display to disarm and reset the system.

Figure 3:
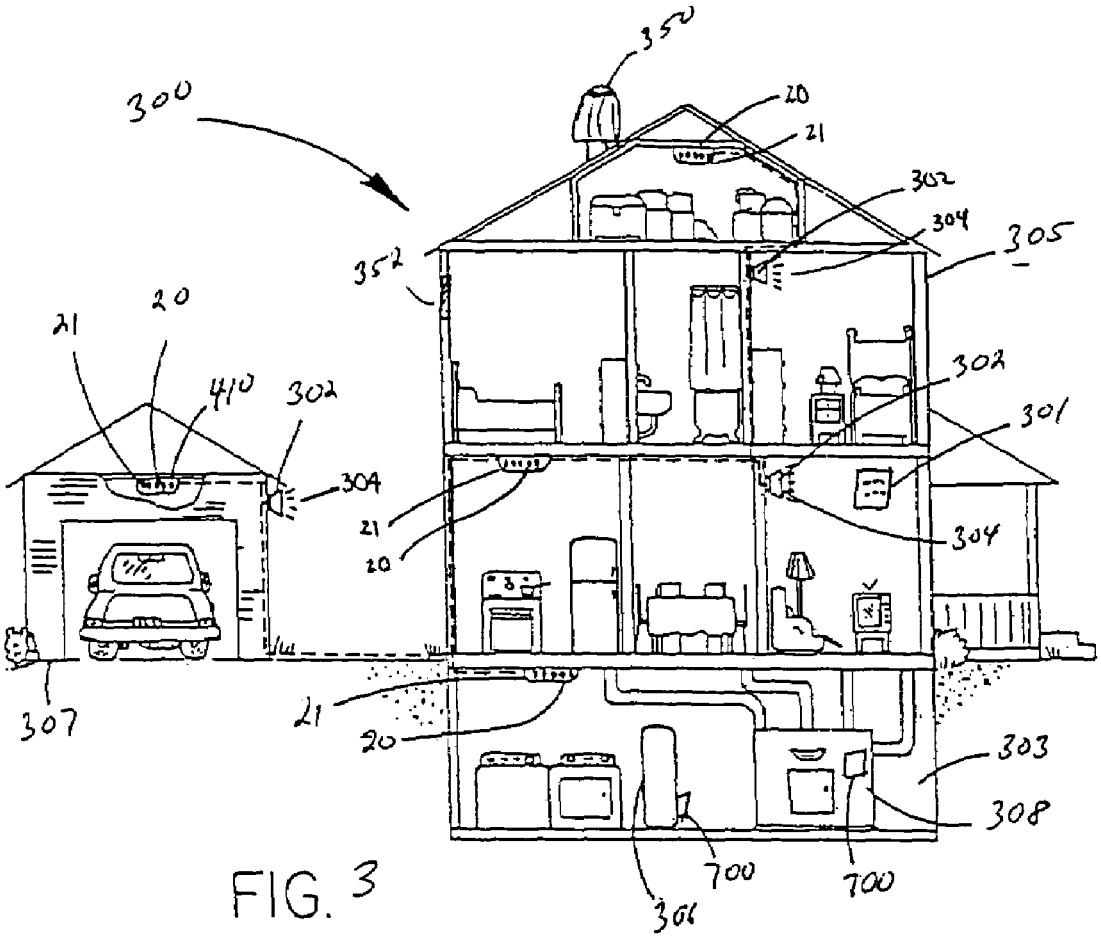
FIG. 3 is an illustration of the system of FIG. 1 installed in a structure.

FIG. 3 shows the system of FIG. 1 installed in a residential structure 300 with a basement 303, garage 307, and upstairs living quarters 305. The detectors 20 are placed throughout the structure 300, each one surrounded and protected by a housing 21. Audible alarm sirens 302 are also placed throughout the structure 300. A visual indicator 304, such as a strobe light, is installed as well. A central display 301 provides visual indicators to display system status.

An exhaust fan 350 is installed on the roof and a motorized vent, or damper 352 is installed in the wall of the structure 300. Normally, the damper 352 is open and the exhaust fan 350 operating to create a continuous flow of fresh air throughout the structure 300. Both the fan 350 and damper 352 are operably connected to the control circuit 22 so that they are operated in accordance with system logic, enabling the intelligent response to fire and CO detection outlined above.

There may be a number of dampers 352 and fans 350 installed throughout the structure 300. For ease of illustration, this example shows only one pair. It should be understood, however, that where there are a number of dampers 352 and fans 350, the system will react locally, i.e., activate system components accordingly in the affected area. For example, detecting CO in the garage 307 will cause the garage door (not shown) and a local damper (not shown) installed in the garage wall to open, and an exhaust fan (not shown) installed in the garage to operate. Any dampers 352 and fans 350 installed in the main structure 300 would not be affected by the detection of CO in the garage 307. The same holds true with the detection of fire. If fire is detected in the main structure 300, ventilation is cut off in the main structure 300, but not in the garage 307. This may be further localized to cutting ventilation off at the floor where fire is detected.

In accordance with further aspects of the invention, a garage door module 410 is placed in the garage 307 and operation modules 700 on the water heater 306 and heater unit 308. The garage module 410 is wired into the garage door opener to open the garage door if carbon monoxide is detected in the garage and the operation modules 700 are configured to shut down the water heater 306 and heater unit 308 when carbon monoxide reaches a certain level. The modules are connected to the control circuit 22 (e.g., a processor such as a microprocessor), sending detection information and receiving control signals to operate their respective components accordingly.

Figure 4:
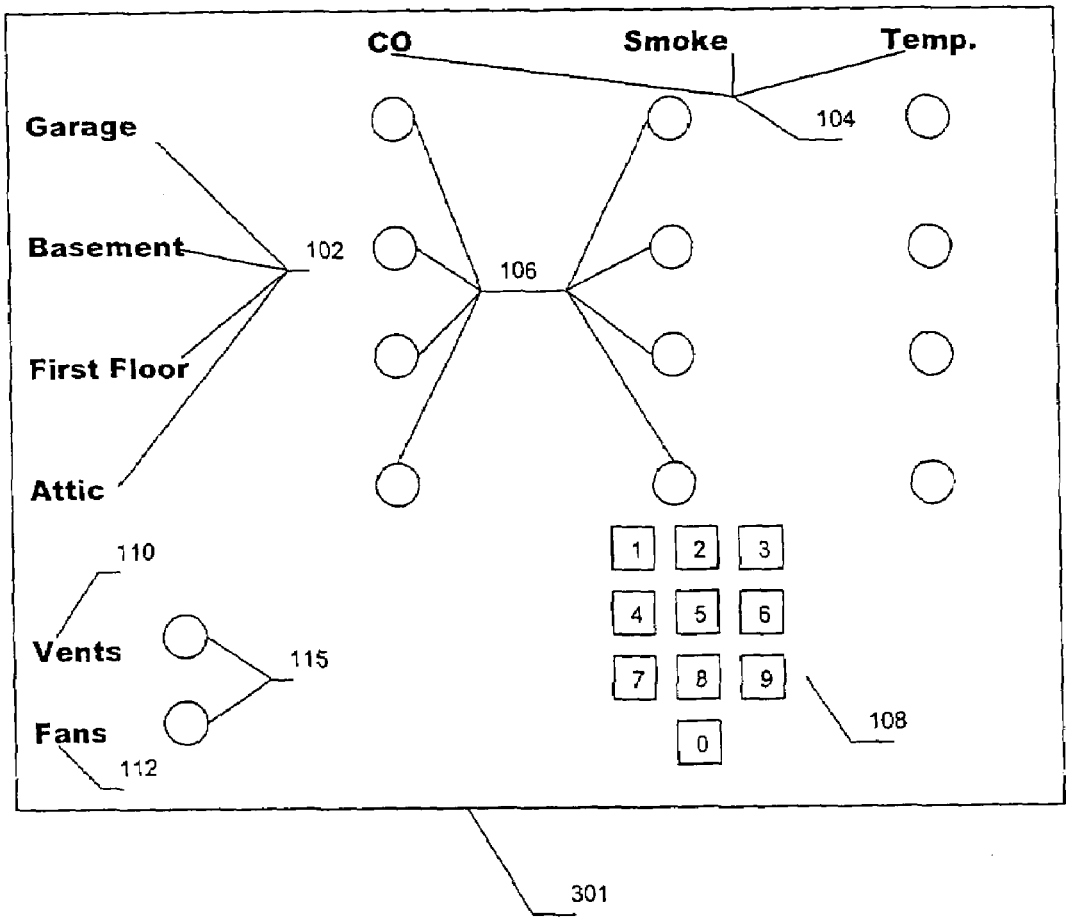
FIG. 4 shows a central display according to an embodiment of the present invention.

FIG. 4 is a diagram of an exemplary central display 301 according to an embodiment of the present invention. Structure area indicators 102 for rows and hazard indicators 104 at the top of columns form a table with an LED 106 at each intersection of an area and a hazard. The LEDs may change color from green to red, green indicating no hazard, red indicating danger. For example, a red LED 106 under "Smoke" 104 and next to "Attic" 102 indicates that smoke is present in the attic. A red LED under "CO" and next to "Garage" indicates CO is detected in the garage. LEDs 115 are also provided to indicate the state of the ventilation system with system indicators for the vents 110 and fans 112. A green LED may indicate the component is open or operating. In this case, a green LED indicates an open vent and an operating fan. The central display contains a key pad 108 for activating and de-activating the system.

Figures 5, 6, 7:
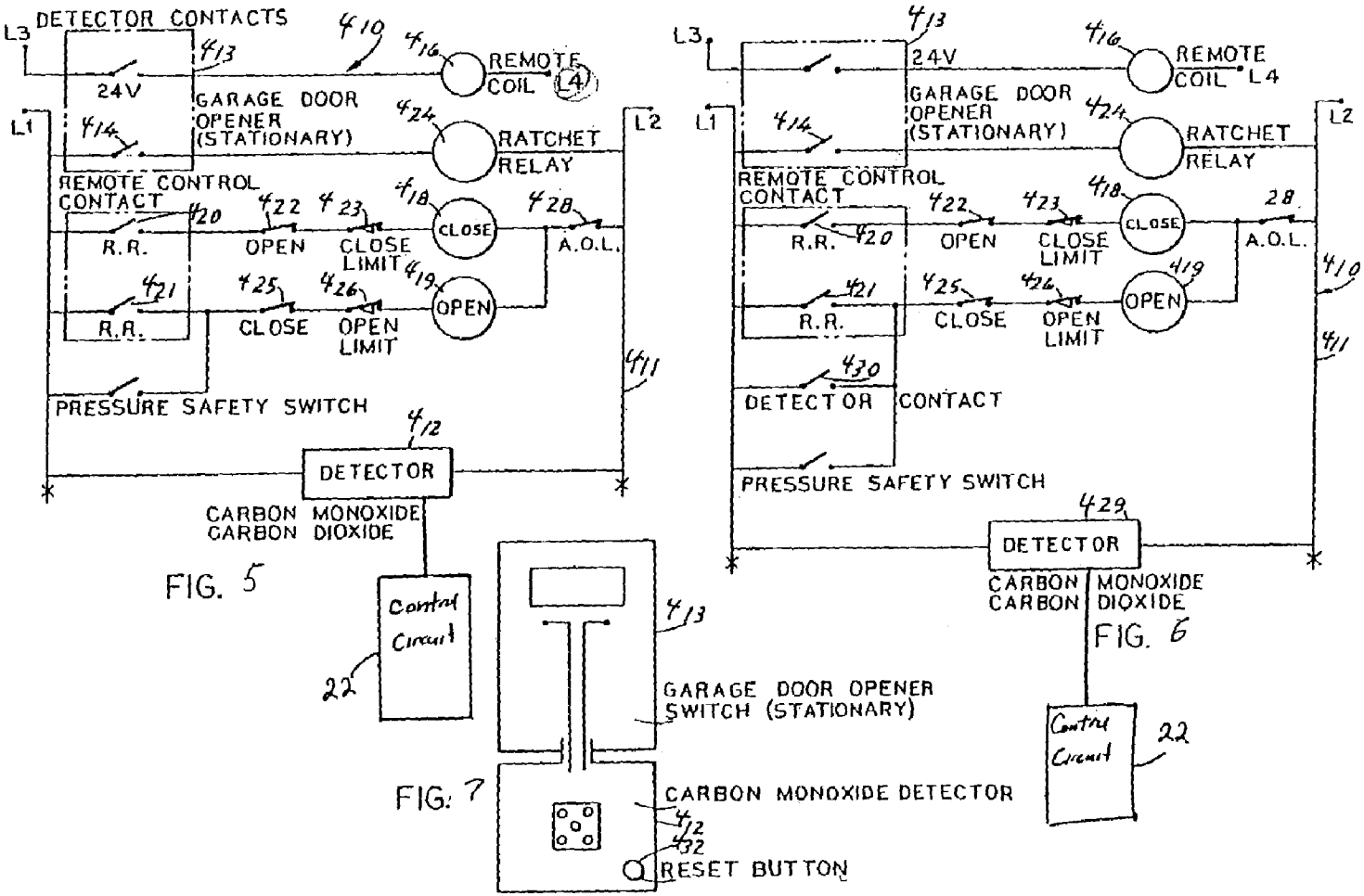
FIG. 5 illustrates a garage door operation module in accordance with an embodiment of the present invention.
FIG. 6 illustrates an alternative embodiment of the module of FIG. 9.
FIG. 7 shows the placement of a detector in a garage door opener switch.
Figure 7:
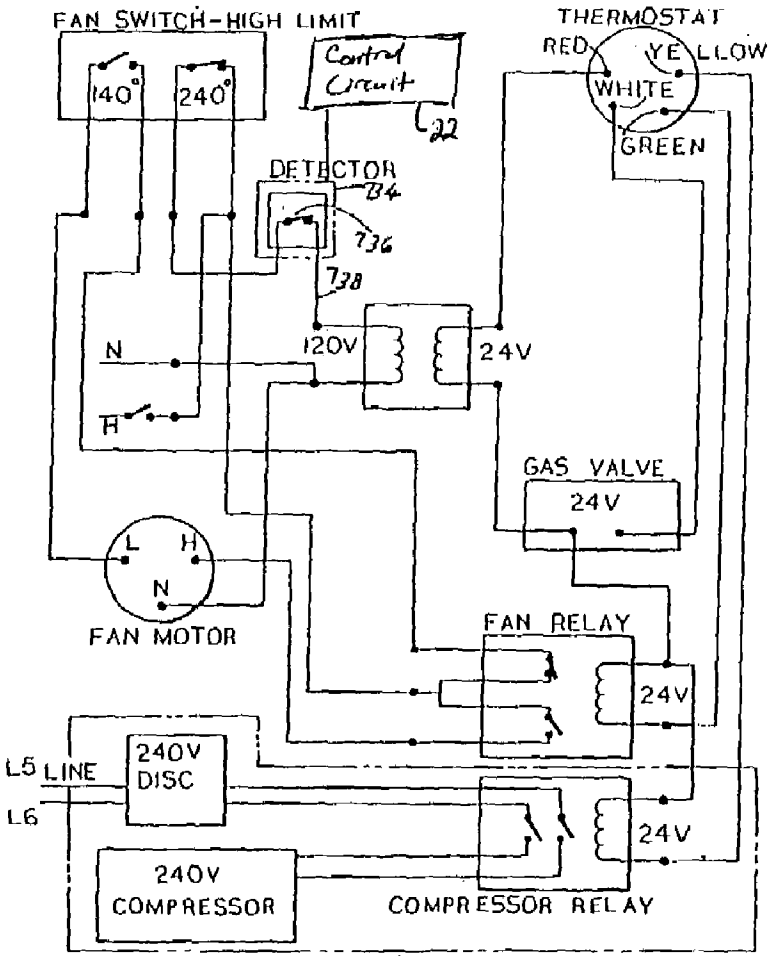

Referring to FIGS. 5–7, there is illustrated prior art modules 410 (coupled to the control circuit 22 according to an embodiment of the present invention) for use with a garage door opener circuit 411, either in an existing unit (FIG. 5) or a new installation, (FIG. 6) as described in U.S. Pat. No. 5,576,739. FIGS. 5 and 6 illustrate a garage door module 410 for use with an existing garage door opener circuit 411. In normal use, the position of the garage door, either opened or closed, is controlled by a stationary garage door opener switch 413 or by a remote control contact 414 by means of a remote coil 416. The garage door opener circuits 411 include normally close branch 418 and normally open branch 419. Each includes a set of contacts 420 and 421 from relay 424. When the garage door is closed, the open switch 422 in the close branch 418 is open. The close limit switch 423 controls the closed position of the garage door. At the same time, in the open branch 419, the close switch 425 is open. The open limit switch 426 controls the open position of the garage door and prevents the door from opening too far. To open the closed door, the stationary garage door opener switch 413 is depressed to close the switch contacts (not shown) or the remote control contact 414 is closed by depressing the switch on the remote control unit (not shown) which energizes the remote coil 416. Remote coil 416 power source $L_3$, $L_4$ is a 24 volt control circuit. When the garage door opener switch 413 or remote control contact 414 is closed, the relay 424 is energized, which in turn energizes the open branch 419 so that the current passes from the relay 424 through the close switch 425, the open limit switch 426, and through the all over load switch 428 to complete the "open" branch 419 thereby opening the door.

The carbon monoxide detector 412 (FIG. 5) and 429 (FIG. 6) is placed in the garage door opener circuit 411 and preferably is installed at the bottom of the stationary garage door opener control 413, as illustrated in FIG. 7, mounted at about five feet above the finish floor to insure proper metering. The carbon monoxide detector 412 (FIG. 5) and 429 (FIG. 6) is preferably calibrated relatively low (200–400 ppm) so as to detect the presence of carbon monoxide before any occupants of the garage or other building are aware of it.

Other calibrations can be used. For example, the detector can be calibrated to respond when the concentration of carbon monoxide in the air is 50 ppm for six hours, 200 ppm for one-half hour or 400 ppm at any time.

FIG. 5 illustrates a system for an existing garage door opener arrangement. For installation in an existing garage door opener, the carbon monoxide detector 412 can be placed next to the garage door opener switch 413 with the wires from the carbon monoxide detector 412 connected to the stationary garage door opener switch 413 by means of quick connect wire crimps as illustrated in FIG. 6. With this system, the carbon monoxide detector 412 contacts are normally open. When the detector 412 senses the presence of a high level of carbon monoxide, the detector contacts will close at the direction of the control circuit 22, which allows current to pass through the relay 424. Energizing the relay 424 in turn energizes the open branch 419, as previously described, to complete the open branch 419 and open the door. As illustrated in FIG. 7, the carbon monoxide detector 412 includes a reset control 432 so that once the open branch 419 is activated by means of the detector 412 sensing a high level of carbon monoxide to open the door, the door cannot be closed by means of the garage door opener switch 413 or the remote control unit (not shown). Thus, if an automobile is allowed to run inside a closed garage, detector 412 will sense the dangerous level of CO, send the information to the control circuit 22 and then the control circuit 22 will instruct the module 410 how to react. If no fire is detected, the door will open and should not be able to close without first resetting the reset control 432. This will prevent the door from being closed prematurely, before the carbon monoxide gas has been dissipated, particularly by use of a remote control unit. Hence, the module 410 allows the system to automatically open a residence garage or automobile service garage door in the event the carbon monoxide concentration reaches an unsafe level.

FIG. 6 illustrates a system for a newly installed garage door opener. Here, the carbon monoxide detector 429 is placed in the garage door "open" branch 419 of the garage door controlling circuit 411. As with the existing garage door controlling circuit 411 (FIG. 5), the carbon monoxide detector contacts 430 are normally open. When the detector senses a preselected concentration of carbon monoxide, it will send a signal to the control circuit 22, which will close the detector contacts 430 allowing current to energize the open branch 419 as previously described, thereby opening the garage door, assuming there is no smoke detected.

Figure 8:
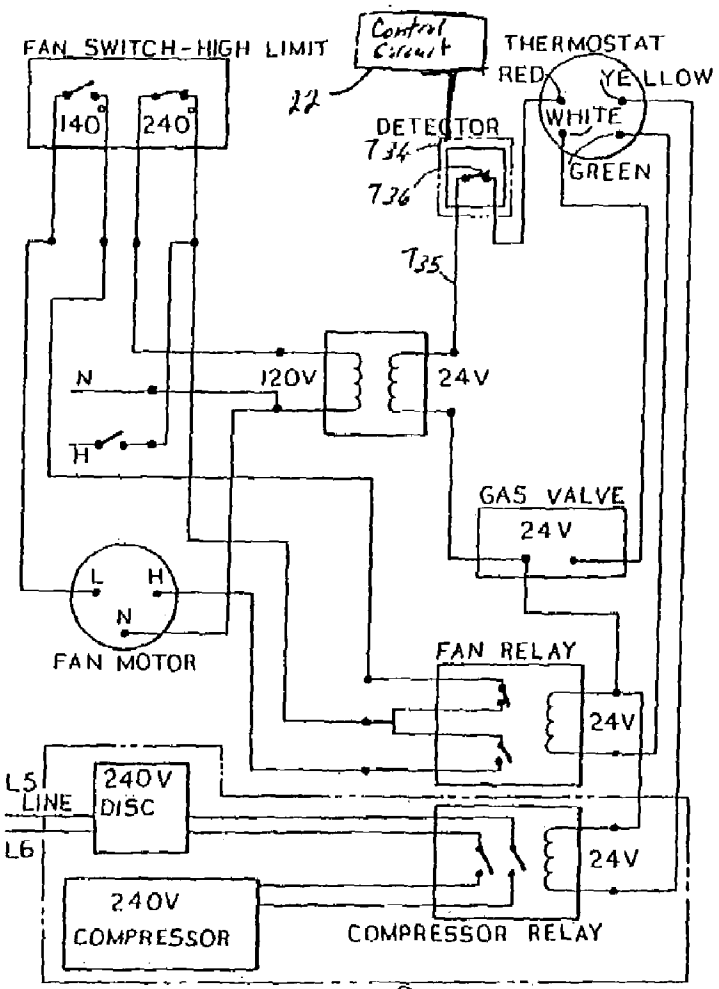
FIG. 8 is a wiring diagram of a furnace operation module in accordance with an embodiment of the present invention.

FIGS. 8 and 9 illustrate a prior art module (coupled to the control circuit 22 according to an embodiment of the present invention) for use with a furnace. FIG. 8 illustrates an existing furnace and air conditioning system. For convenience, the carbon monoxide detector 734 is positioned in the thermostat circuit 735 which is 24 volt rated and easier for the individual homeowner to work with. The detector contacts 736 are normally closed so that the thermostat circuit 735 is complete and the furnace can operate. In the event the carbon monoxide concentration reaches the specified level, the control circuit 22 will recognize the dangerous level on the detector 734 and the circuit 22 will respond as discussed above. The contacts 736 will open interrupting the thermostat circuit 735 and the furnace will shut down. An optional air conditioning system is shown, operated by a 240 volt power source, $L_5$, $L_6$, generally located outside the building.

FIG. 9 illustrates a system for a new installation. Here the carbon monoxide detector 734 is placed directly in the 120 volt rate transformer circuit 738 so that it is responsive to the specified concentration of carbon monoxide gas, the detector contacts 736 will open at the direction of the control circuit 22, thereby interrupting the power source to the furnace which will stop operating so that the generation of carbon monoxide gas will stop.

In similar fashion, the module can be utilized to activate a ventilation system, deactivate a water heater, and the like, all responsive to the detection of a preselected level of carbon monoxide in proximity to the dater heater, etc. Injury from other noxious gases can likewise be minimized by use of the present invention.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. An intelligent warning system comprising:

a detector;

a control circuit operably connected to the detector;

an alarm operably connected to the control circuit;

a ventilation system operably connected to the control circuit;

wherein the control circuit receives location data from the detector and activates the alarm and ventilation system as a function of the data, wherein the function is a method comprising the steps of:

shutting ventilation in response to smoke detection in a first room corresponding to the location data;

shutting ventilation in an area adjacent to the first room upon detecting smoke;

increasing ventilation in response to carbon monoxide detection in a second room corresponding to the location data;

increasing ventilation in an area adjacent to the second room upon detecting carbon monoxide;

contacting emergency services and activating the alarm in response to smoke or carbon monoxide detection.

2. The system of claim 1, wherein the location data further comprises temperature data and wherein the step of contacting comprises contacting emergency services and activating an alarm in response to smoke, high temperature or carbon monoxide detection.

3. The system of claim 1, wherein the method further comprises:

opening a garage door, shutting down a gas furnace, and shutting down a water heater in response to carbon monoxide detection.

4. The system of claim 1, wherein the contacting step further comprises contacting a police department, a fire department and a treatment center.

5. The system of claim 1, wherein the alarm further comprises audio and visual alarms.

6. The system of claim 5, wherein the visual alarms further comprise strobe lights and LEDs.

7. The system of claim 1, wherein the ventilation system further comprises a number of vents and an exhaust fan.

8. The system of claim 1, further comprising a module operably connected to the control circuit, the operation module constructed and arranged to operate a component to which it is attached, the module operating at the direction of the control circuit.

9. The system of claim 8, wherein the module is attached to a garage door opener.

10. The system of claim 8, wherein the module is attached to a water heater.

11. The system of claim 8, wherein the module is attached to a furnace.

12. The system of claim 8, wherein the module is attached to a vent.

13. The system of claim 8, wherein the module is attached to a fan.

14. The system of claim 1, wherein the control circuit is a processor.

15. An intelligent warning system comprising:

a detector;

a control circuit operably connected to the detector;

an alarm operably connected to the control circuit;

a ventilation system operably connected to the control circuit; wherein the control circuit receives location data from the detector and activates the alarm and ventilation system as a function of the data, wherein the function is a method comprising the steps of:

shutting ventilation in response to smoke detection in a first room corresponding to the location data;

shutting ventilation in an area adjacent to the first room upon detecting smoke;

contacting emergency services and activating the alarm in response to the smoke detection.

16. An intelligent warning system comprising:

a detector;

a control circuit operably connected to the detector;

an alarm operably connected to the control circuit;

a ventilation system operably connected to the control circuit; wherein the control circuit receives location data from the detector and activates the alarm and ventilation system as a function of the data, wherein the function is a method comprising the steps of:

increasing ventilation in response to carbon monoxide detection in a second room corresponding to the location data;

increasing ventilation in an area adjacent to the second room upon detecting carbon monoxide;

contacting emergency services and activating the alarm in response to the carbon monoxide detection.

* * * * *